US007365688B2

(12) United States Patent
Tseng et al.

(10) Patent No.: US 7,365,688 B2
(45) Date of Patent: Apr. 29, 2008

(54) FLAT MINIATURIZED ANTENNA OF A WIRELESS COMMUNICATION DEVICE

(75) Inventors: Kuan-Hsueh Tseng, Taipei Hsien (TW); Chih-Lung Chen, Taipei Hsien (TW)

(73) Assignee: Wistron NeWeb Corporation, Hsi-Chih, Taipei Hsien (TW)

( * ) Notice: Subject to any disclaimer, the term of this patent is extended or adjusted under 35 U.S.C. 154(b) by 0 days.

(21) Appl. No.: 11/464,208

(22) Filed: Aug. 14, 2006

(65) Prior Publication Data

US 2008/0018537 A1 Jan. 24, 2008

(30) Foreign Application Priority Data

Jul. 20, 2006 (TW) ..... 95126493 A

(51) Int. Cl.
*H01Q 1/38* (2006.01)
*H01Q 1/36* (2006.01)

(52) U.S. Cl. ..... 343/700 MS; 343/895

(58) Field of Classification Search ..... 343/700 MS, 343/702, 895, 792, 846
See application file for complete search history.

(56) References Cited

U.S. PATENT DOCUMENTS

| | | | | |
|---|---|---|---|---|
| 5,986,609 | A * | 11/1999 | Spall | 343/702 |
| 6,392,599 | B1 * | 5/2002 | Ganeshmoorthy et al. | 343/700 MS |
| 6,946,997 | B2 * | 9/2005 | Yuanzhu | 343/700 MS |
| 7,106,253 | B2 * | 9/2006 | Yuanzhu | 343/700 MS |
| 2002/0024474 | A1 * | 2/2002 | Chen | 343/792 |

* cited by examiner

*Primary Examiner*—Hoang V Nguyen
(74) *Attorney, Agent, or Firm*—Winston Hsu

(57) ABSTRACT

A flat miniaturized antenna of a wireless communication device includes a baseboard, a sleeve conductor formed on the baseboard and coupled to system ground, a meander-shaped conductor formed inside the sleeve conductor and isolated from the sleeve conductor, having a wide end and a narrow end, a feed-in end formed on the wide end of meander-shaped conductor, for transmitting wireless signals to the wireless communication device, and a branch conductor coupled to the meander-shaped conductor.

13 Claims, 14 Drawing Sheets

FLAT MINIATURIZED ANTENNA OF A WIRELESS COMMUNICATION DEVICE

BACKGROUND OF THE INVENTION

1. Field of the Invention

The present invention relates to a flat miniaturized antenna of a wireless communication device, and more specifically, to a flat miniaturized antenna capable of reducing the entire size of the flat miniaturized antenna and effects from environment and mechanism for broadening bandwidth for enhancing transmitting and receiving efficiency of wireless signals.

2. Description of the Prior Art

In recent years, with the development of the wireless communication technology, consumer wireless communication technology and equipments thereof have been improved rapidly. Therefore, it is more convenient to users for information gathering and personal communication. A user can get every kind of information easily by using various portable electronic products. Portable electronic products, such as mobile phones and notebooks, can be coupled to a network wirelessly through a WWAN (wireless wide area network). In other words, a user still can browse the Internet and receive email by using portable electronic products even if there is no wireless access point.

Information exchanges between a portable electronic product and a network end must need an antenna in charge of transmitting and receiving signals. In general, the antenna is usually hidden in the portable electronic product, such as a flat antenna. However, a hidden antenna has many drawbacks, such as low efficiency, low power, high quality factor, low polarization, narrow width, and so on. Therefore, when the portable electronic product is coupled to the network wirelessly, effects from environment and mechanism will lower connection efficiency.

SUMMARY OF THE INVENTION

The present invention discloses a flat miniaturized antenna of a wireless communication device comprising a baseboard, a sleeve conductor formed on the baseboard and coupled to system ground, a meander-shaped conductor formed inside the sleeve conductor in a reciprocating bent manner and isolated from the sleeve conductor, and a feed-in end formed on an end of the meander-shaped conductor close to the sleeve conductor for transmitting wireless signals received by the meander-shaped conductor to the wireless communication device.

The present invention further discloses a flat miniaturized antenna of a wireless communication device comprising a baseboard, a meander-shaped conductor formed on the baseboard in a reciprocating bent manner having a wide end and a narrow end, and a feed-in end formed on the wide end of meander-shaped conductor for transmitting wireless signals received by the meander-shaped conductor to the wireless communication device.

The present invention further discloses a flat miniaturized antenna of a wireless communication device comprising a baseboard, a meander-shaped conductor formed on the baseboard in a reciprocating bent manner, a feed-in end formed on an end of the meander-shaped conductor for transmitting wireless signals received by the meander-shaped conductor to the wireless communication device, and a branch conductor coupled to the meander-shaped conductor.

The present invention further discloses a flat miniaturized antenna of a wireless communication device comprising a baseboard, a sleeve conductor formed on the baseboard and coupled to system ground, a meander-shaped conductor formed inside the sleeve conductor and isolated from the sleeve conductor, the width of an end of the meander-shaped conductor close to the sleeve conductor being greater than the width of the other end, a feed-in end formed on a wider end of the meander-shaped conductor for transmitting wireless signals received by the meander-shaped conductor to the wireless communication device, and a branch conductor coupled to the meander-shaped conductor.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
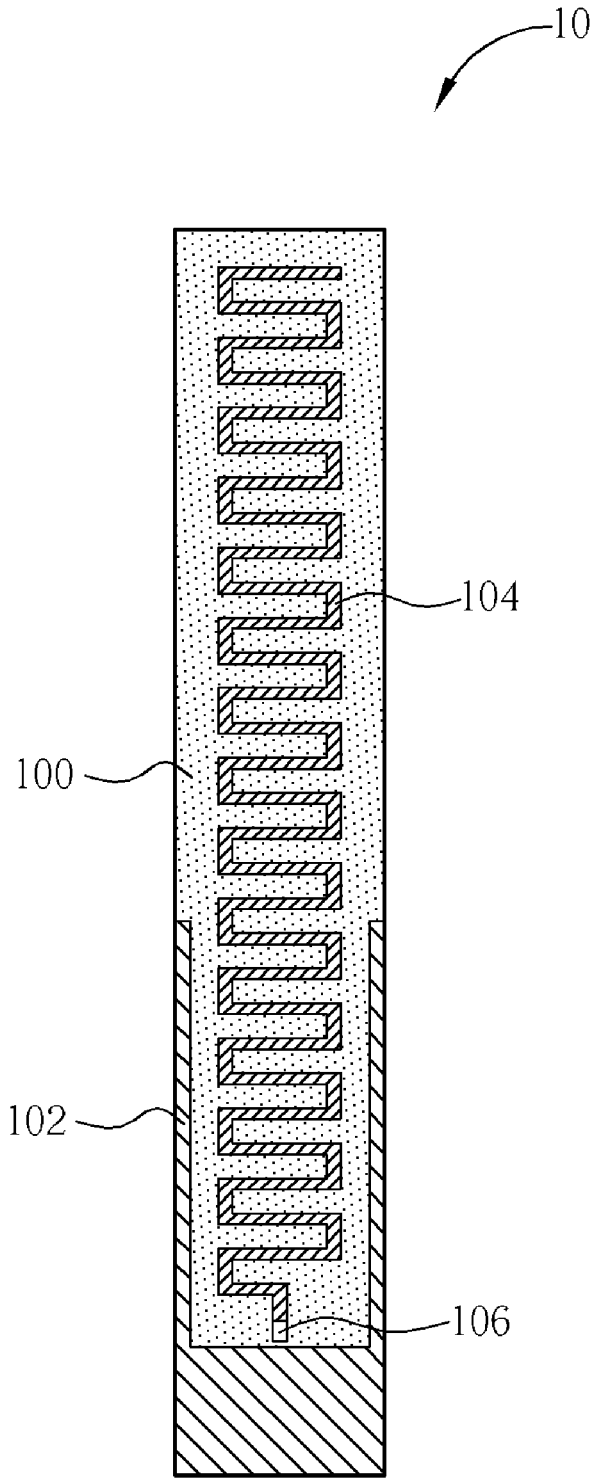
FIG. 1 is a diagram of a flat miniaturized antenna of a wireless communication device according to the first embodiment of the present invention.

Please refer to FIG. 1. FIG. 1 is a diagram of a flat miniaturized antenna 10 of a wireless communication device according to the first embodiment of the present invention. The flat miniaturized antenna 10 comprises a baseboard 100, a sleeve conductor 102, a meander-shaped conductor 104, and a feed-in end 106. The baseboard 100 is made of a dielectric material or a magnetic material for disposing conductors made of copper foils or other materials. The sleeve conductor 102 is formed on the baseboard 100 and is coupled to system ground (not shown in FIG. 1). The shape of the sleeve conductor 102 is like a sleeve. The meander-shaped conductor 104 stretches outward from the cuff of the sleeve conductor 102 in a reciprocating bent manner for forming the radiator of the flat miniaturized antenna 10. The feed-in end 106 is formed on an end of the meander-shaped conductor 104 close to the sleeve conductor 102 for transmitting wireless signals received by the meander-shaped conductor 104 to the wireless communication device.

As known by those skilled in the art, the length of the radiator of the flat miniaturized antenna 10 must be larger than at least a quarter of the wavelength of the transmitted or received wireless signal, that is to say, the length of the meander-shaped conductor 104 is needed to be about a quarter of the wavelength of the signal fed into the feed-in end 106 preferably. However, the total length of the flat miniaturized antenna 10 can be shortened in the reciprocating bent manner. In such a manner, the volume of the flat miniaturized antenna 10 can be reduced. For example, the length of the radiator of the antenna in a 900 MHz GSM (global system for mobile communication) can be shortened from 9 cm about to 5 cm through the reciprocating manner.

Figure 2:
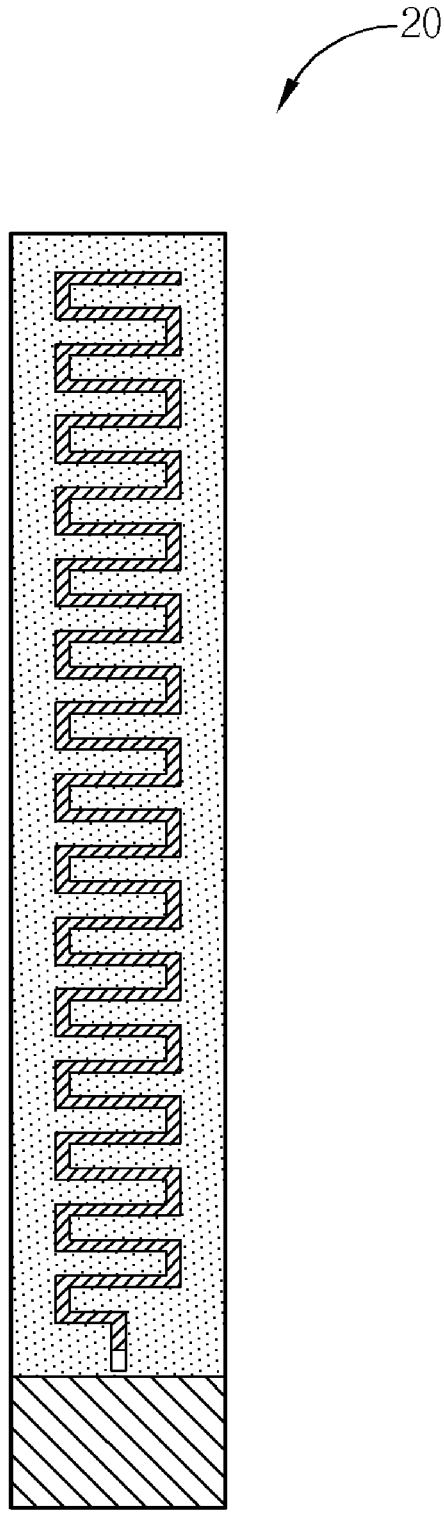
FIG. 2 is a diagram of an antenna.
Figure 3:
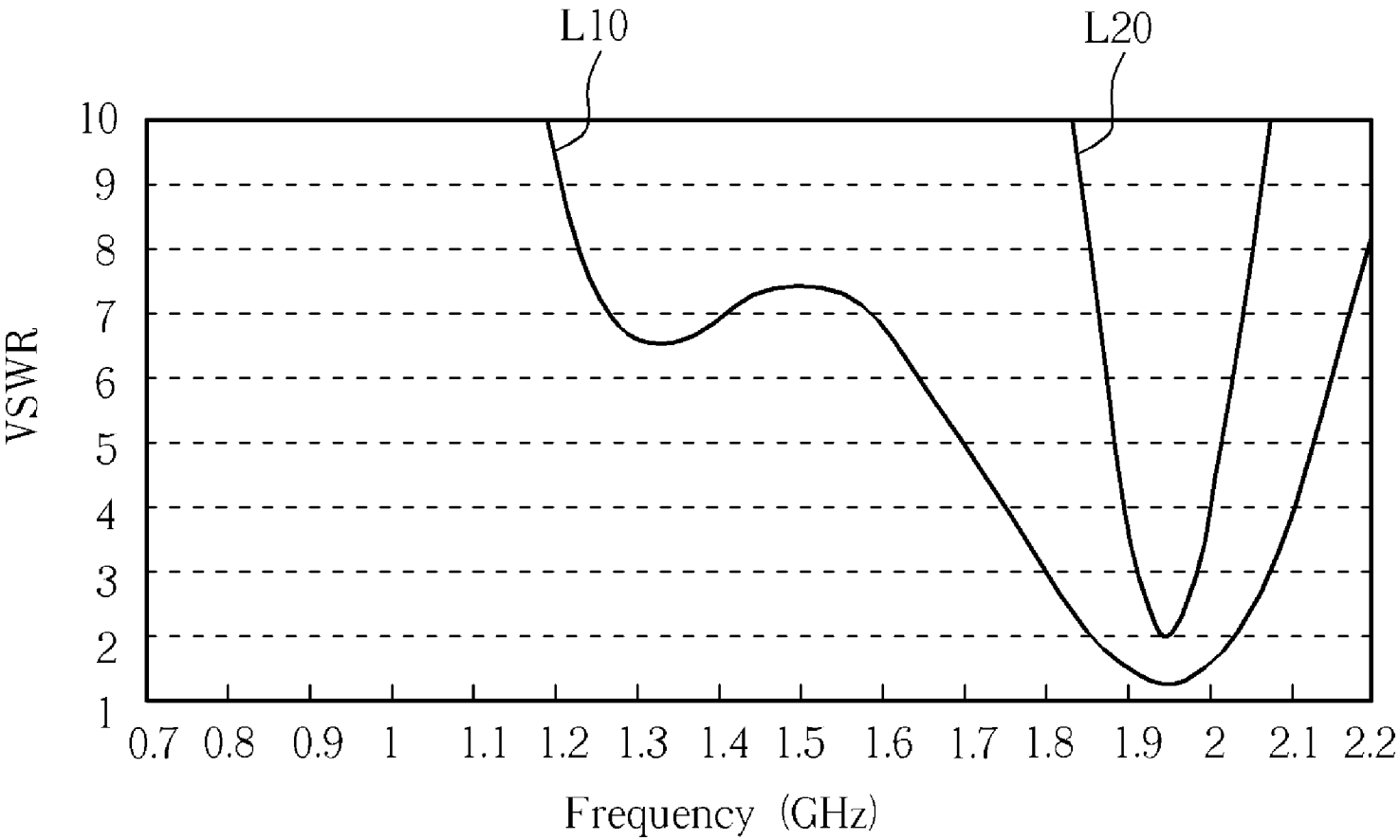
FIG. 3 is a VSWR (Voltage Standing Wave Ratio) diagram of the flat miniaturized antenna in FIG. 1 and the antenna in FIG. 2.

Besides, the sleeve conductor 102 can broaden the bandwidth of the flat miniaturized antenna 10. The length of the sleeve conductor 102 is also about a quarter of the wavelength of the signal fed into the feed-in end 106. Please refer to FIG. 2. FIG. 2 is a diagram of an antenna 20. The only difference between the flat miniaturized antenna 10 and 20 is that there is no sleeve conductor in the antenna 20. Please refer to FIG. 3. FIG. 3 is a VSWR (Voltage Standing Wave Ratio) diagram of the flat miniaturized antenna 10 in FIG. 1 and the antenna 20 in FIG. 2. In FIG. 3, a curve L10 represents the VSWR curve of the flat miniaturized antenna 10 and a curve L20 represents the VSWR curve of the antenna 20. As shown in FIG. 3, the bandwidth of the flat miniaturized antenna 10 is obviously greater than the bandwidth of the antenna 20. In other words, through the sleeve conductor 102 and the meander-shaped conductor 104, not only the entire size of the flat miniaturized antenna 10 can be reduced but also the bandwidth of the flat miniaturized antenna 10 can be broadened for increasing the transmitting and receiving efficiency of wireless signals.

Figure 4:
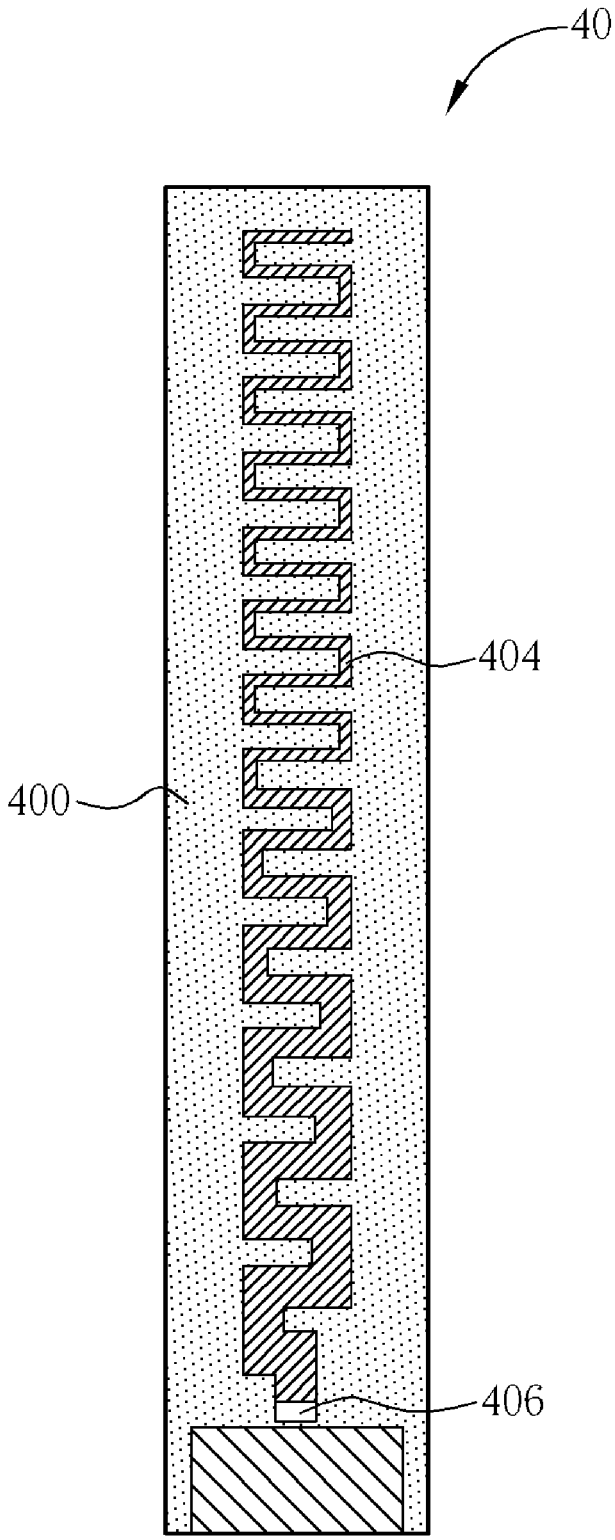
FIG. 4 is a diagram of a flat miniaturized antenna of a wireless communication device according to the second embodiment of the present invention.

Please refer to FIG. 4. FIG. 4 is a diagram of a flat miniaturized antenna 40 of a wireless communication device according to the second embodiment of the present invention. The flat miniaturized antenna 40 comprises a baseboard 400, a meander-shaped conductor 404, and a feed-in end 406. The baseboard 400 is made of a dielectric material or a magnetic material for disposing conductors made of copper foils or other materials. The meander-shaped conductor 404 is formed on the baseboard 400 in a reciprocating bent manner. The meander-shaped conductor 404 has a wide end and a narrow end. The feed-in end 406 is formed on the wide end of the meander-shaped conductor 404 for transmitting wireless signals received by the meander-shaped conductor 404 to the wireless communication device.

As mentioned above, preferably, the length of the meander-shaped conductor 404 is about a quarter of the wavelength of the signal fed into the feed-in end 406. As shown in FIG. 4, the width of the meander-shaped conductor 404 is reduced linearly from the wide end to the narrow end. The bandwidth of the flat miniaturized antenna 40 can be further broadened through the tapering meander-shaped conductor 404 (the relative comparisons are described as follows). Furthermore, Adding a sleeve conductor into the flat miniaturized antenna 40 also can broaden the bandwidth of the flat miniaturized antenna 40.

Figure 5:
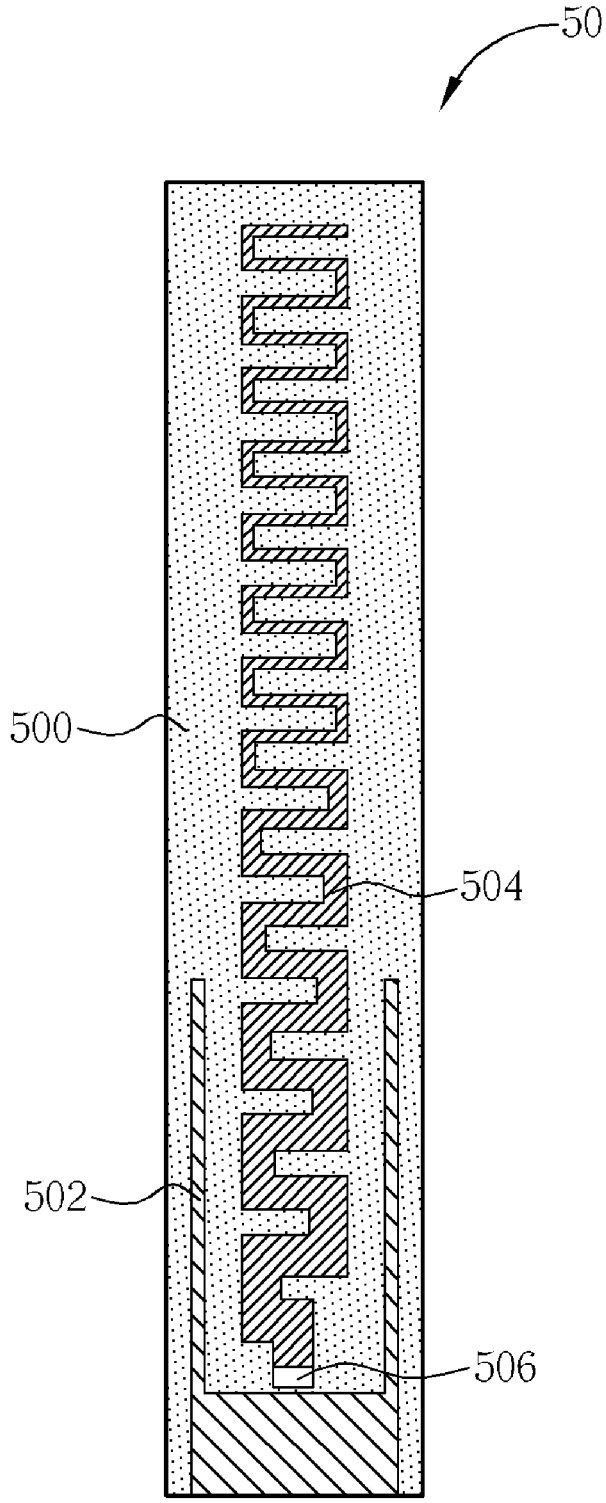
FIG. 5 is a diagram of a flat miniaturized antenna of a wireless communication device according to the third embodiment of the present invention.
Figure 6:
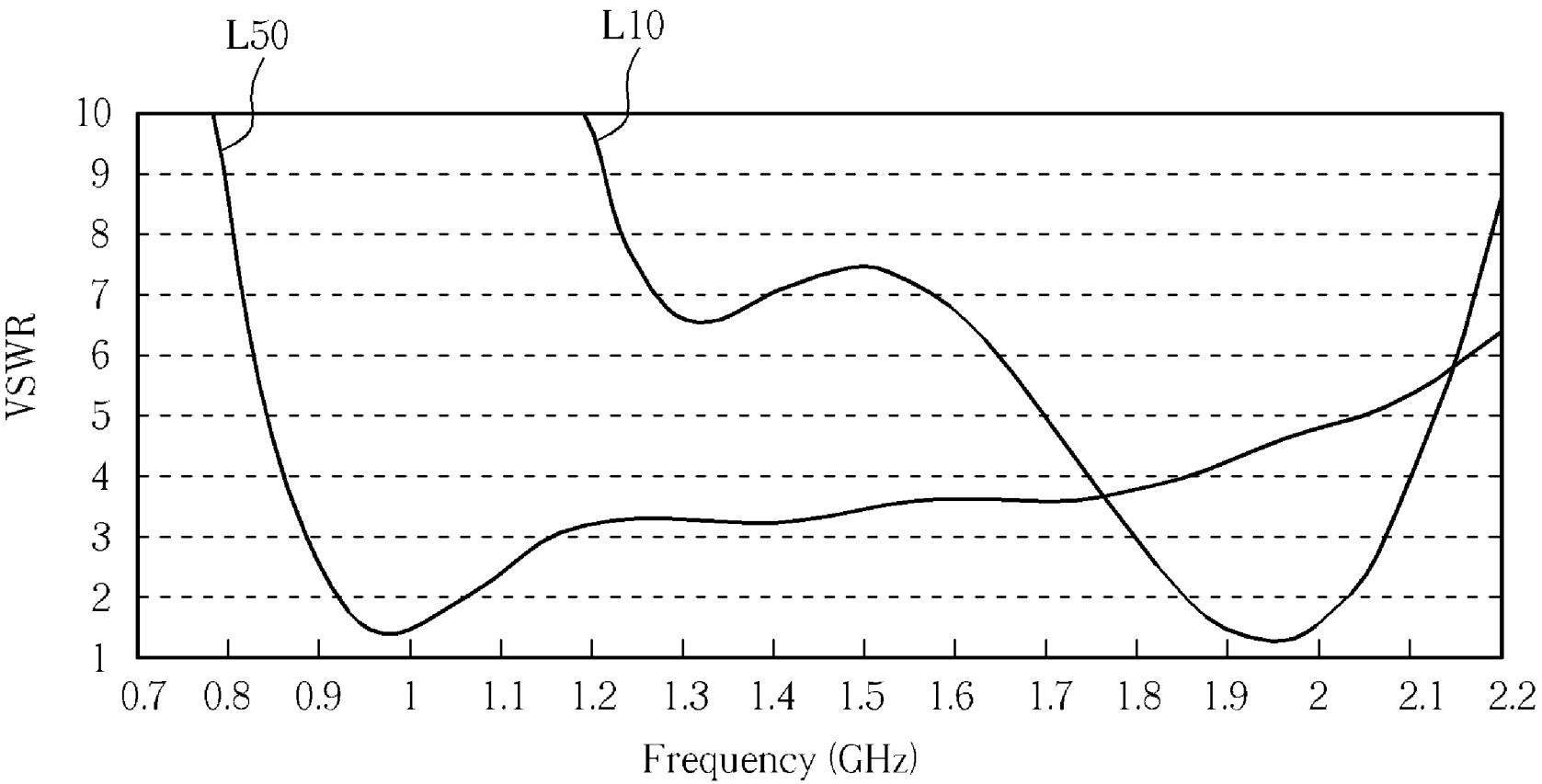
FIG. 6 is a VSWR diagram of the flat miniaturized antenna in FIG. 1 and the flat miniaturized antenna in FIG. 5.

Please refer to FIG. 5. FIG. 5 is a diagram of a flat miniaturized antenna 50 of a wireless communication device according to the third embodiment of the present invention. The flat miniaturized antenna 50 comprises a baseboard 500, a sleeve conductor 502, a meander-shaped conductor 504, and a feed-in end 506. The only difference between the flat miniaturized antenna 40 and 50 is that there is the sleeve conductor 502 in the flat miniaturized antenna 50. Please refer to FIG. 6. FIG. 6 is a VSWR diagram of the flat miniaturized antenna 10 in FIG. 1 and the flat miniaturized antenna 50 in FIG. 5. In FIG. 6, curves L10 and L50 represent VSWR curves of the flat miniaturized antenna 10 and 50 respectively. As shown in FIG. 6, the bandwidth of the flat miniaturized antenna 50 is obviously greater than the bandwidth of the flat miniaturized antenna 10. In other words, through the meander-shaped conductor 504, the bandwidth of the flat miniaturized antenna 10 can be broadened for further increasing the transmitting and receiving efficiency of wireless signals.

Figure 7:
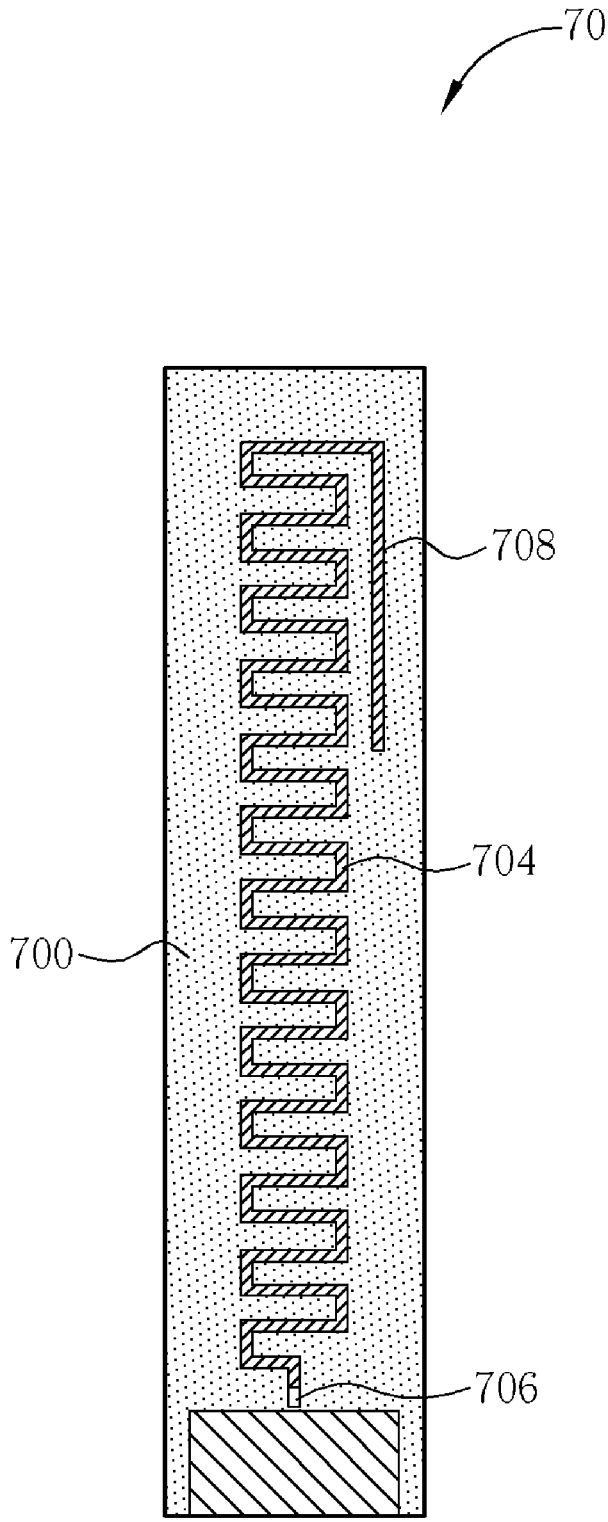
FIG. 7 is a diagram of a flat miniaturized antenna of a wireless communication device according to the fourth embodiment of the present invention.

Please refer to FIG. 7. FIG. 7 is a diagram of a flat miniaturized antenna 70 of a wireless communication device according to the fourth embodiment of the present invention. The flat miniaturized antenna 70 comprises a baseboard 700, a meander-shaped conductor 704, a feed-in end 706, and a branch conductor 708. The baseboard 700 is made of a dielectric material or a magnetic material for disposing conductors made of copper foils or other materials. The meander-shaped conductor 704 is formed on the baseboard 700 in a reciprocating bent manner for forming the radiator of the flat miniaturized antenna 70. The feed-in end 706 is formed on an end of the meander-shaped conductor 704 for transmitting wireless signals received by the meander-shaped conductor 704 to the wireless communication device. The branch conductor 708 stretches from the meander-shaped conductor 704 for broadening the bandwidth of the flat miniaturized antenna 70.

As mentioned above, the length of the radiator of the flat miniaturized antenna 70 must be larger than or equal to at least a quarter of the wavelength of the transmitted or received wireless signal. Therefore, the sum of the length of the meander-shaped conductor 704 and the length of the branch conductor 708 is set to a quarter of the wavelength of the wireless signal. In such a manner, the entire size of the flat miniaturized antenna 70 can be reduced. Furthermore, adding other branch conductors or a sleeve conductor into the flat miniaturized antenna 70 also can broaden the bandwidth of the flat miniaturized antenna 70. And of course, the meander-shaped conductor 704 also can be a tapering meander-shaped conductor.

Figure 8:
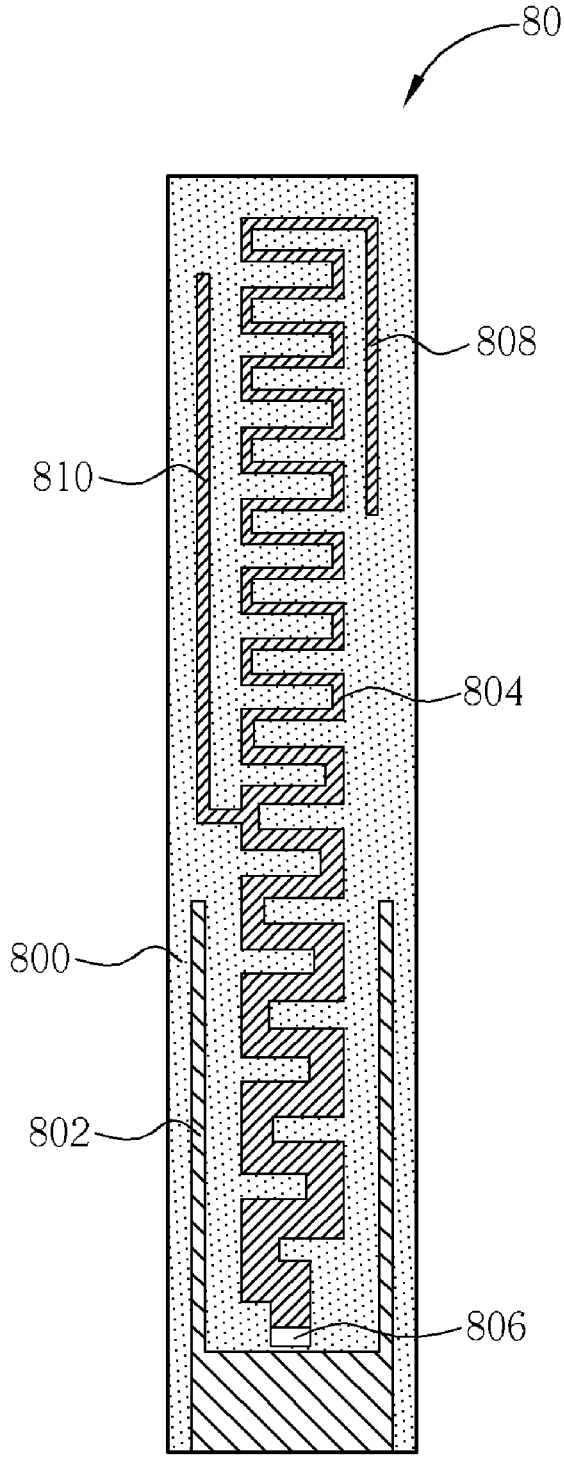
FIG. 8 is a diagram of a flat miniaturized antenna of a wireless communication device according to the fifth embodiment of the present invention.
Figure 9:
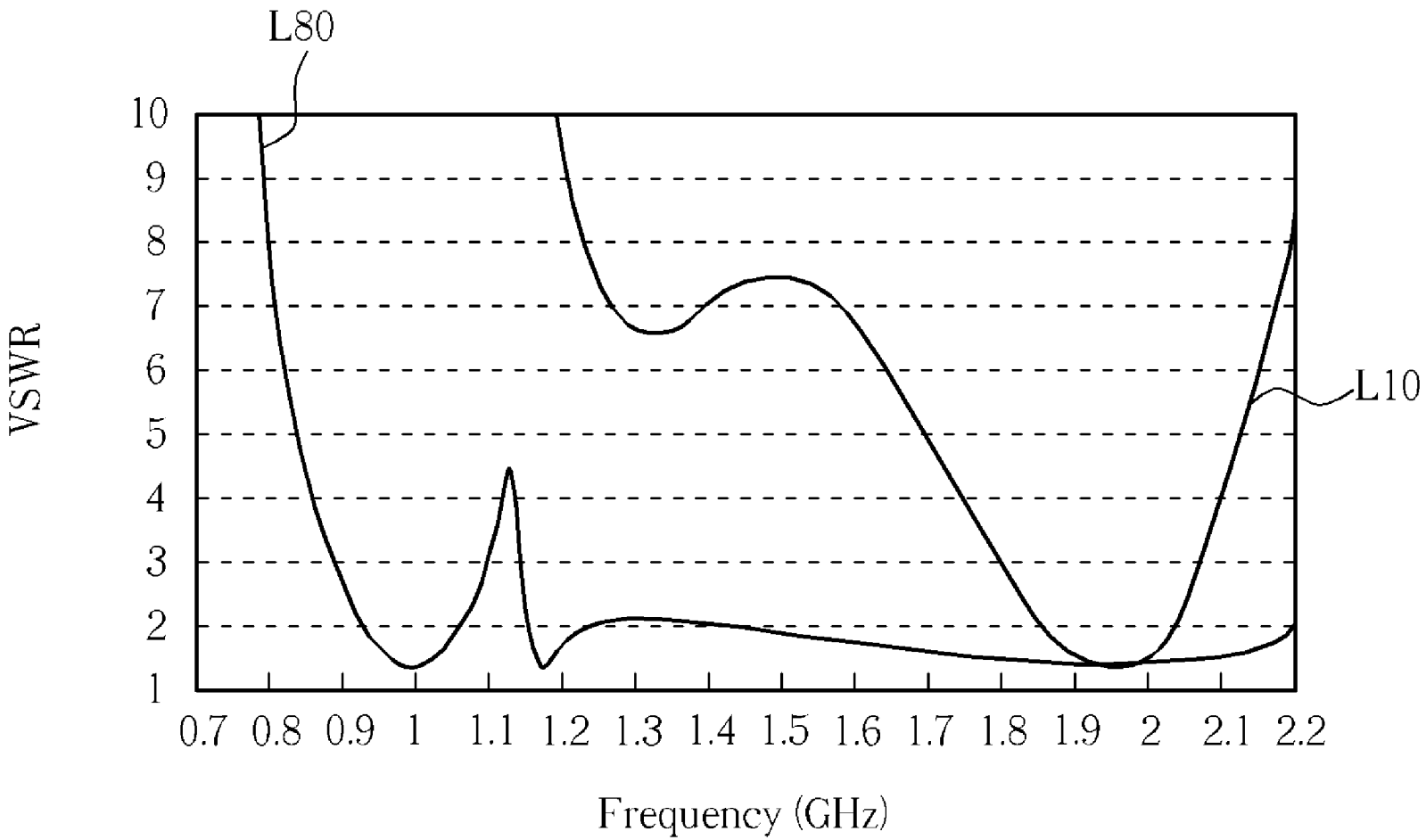
FIG. 9 is a VSWR diagram of the flat miniaturized antenna in FIG. 1 and the antenna in FIG. 8.
Figure 10:
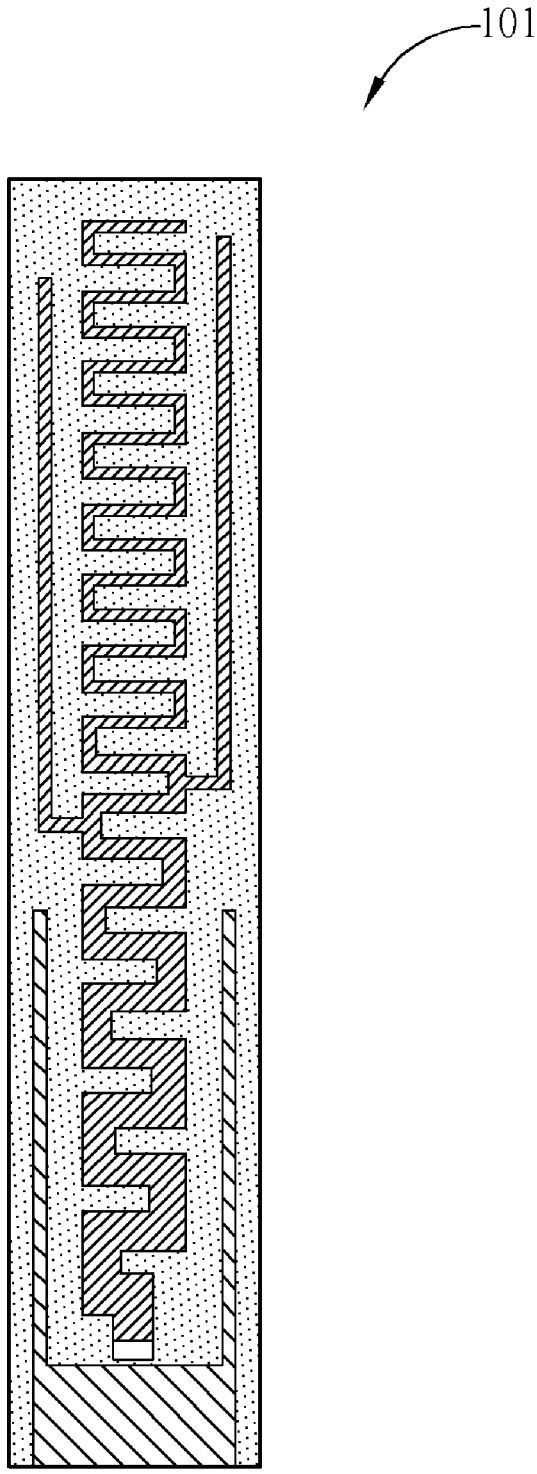
FIGS. 10, 11, 12, 13, and 14 are diagrams of flat miniaturized antennas according to other embodiments of the present invention.
Figure 11:
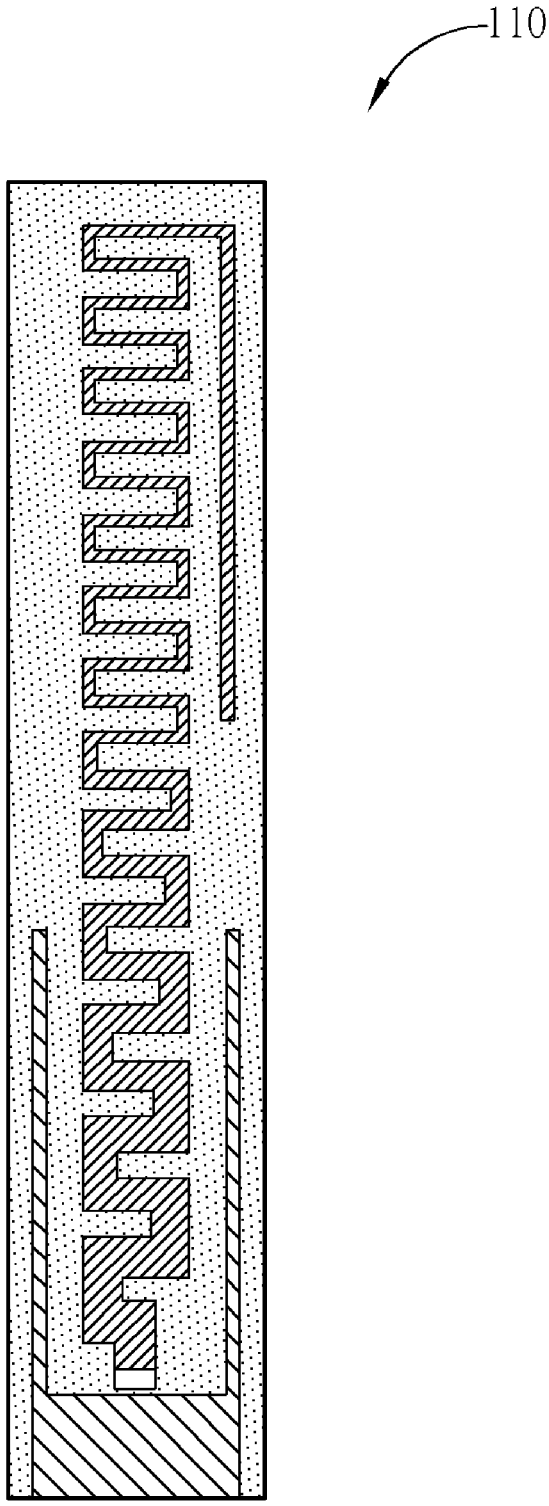
Figure 12:
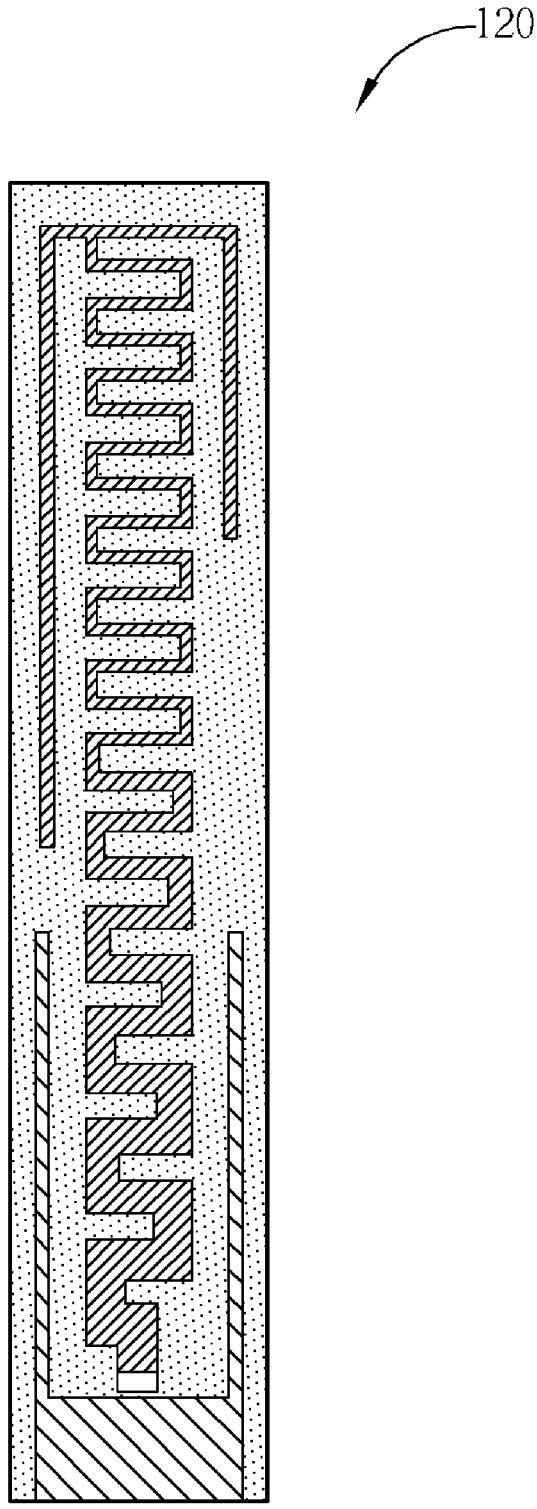
Figure 13:
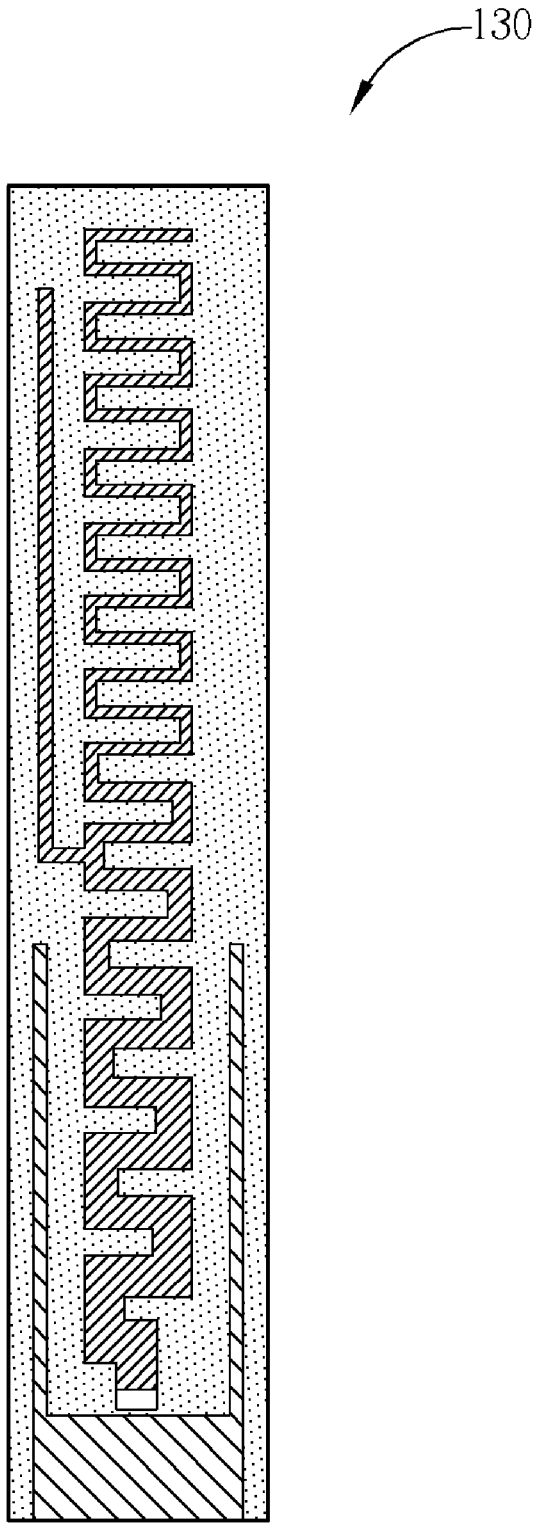
Figure 14:
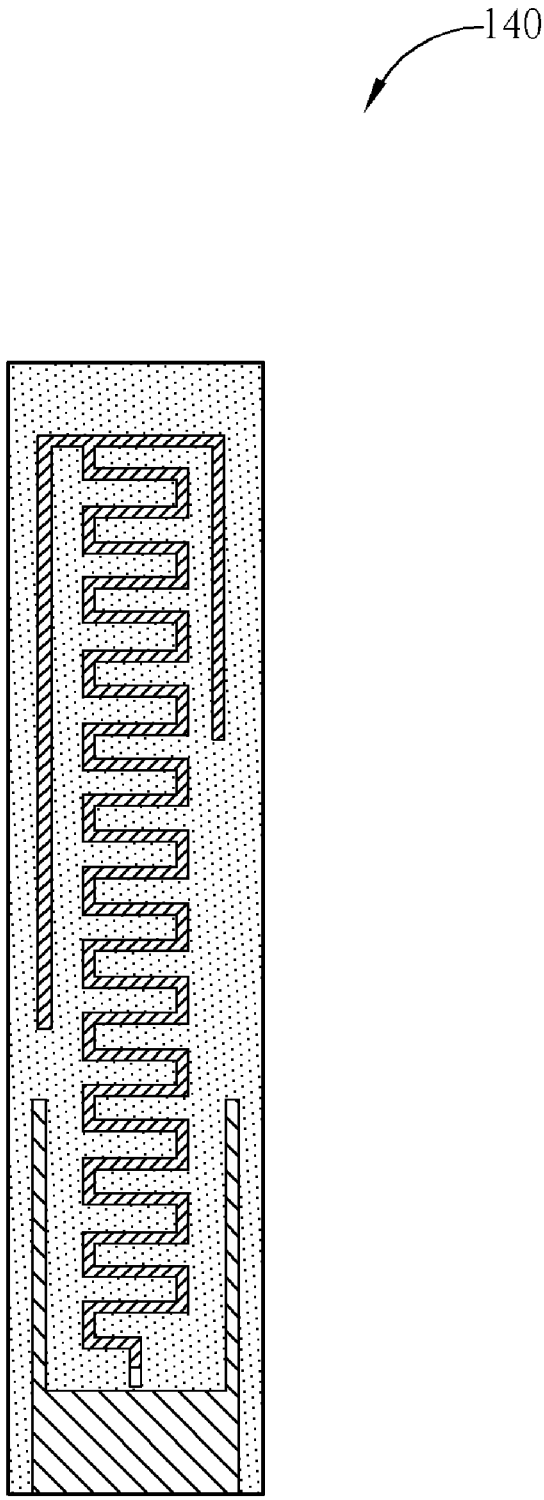

Please refer to FIG. 8. FIG. 8 is a diagram of a flat miniaturized antenna 80 of a wireless communication device according to the fifth embodiment of the present invention. The flat miniaturized antenna 80 comprises a baseboard 800, a sleeve conductor 802, a meander-shaped conductor 804, a feed-in end 806, and branch conductors 808 and 810. The differences between the flat miniaturized antenna 70 and 80 are the sleeve conductor 802 and the branch conductor 810. Please refer to FIG. 9. FIG. 9 is a VSWR diagram of the flat miniaturized antenna 10 in FIG. 1 and the antenna 80 in FIG. 8. In FIG. 9, curves L10 and L80 represent VSWR curves of the flat miniaturized antenna 10 and 80 respectively. As shown in FIG. 9, the bandwidth of the flat miniaturized antenna 80 is obviously greater than the bandwidth of the flat miniaturized antenna 10. In other words, through the sleeve conductor 802, the tapering meander-shaped conductor 804 and the branch conductors 808 and 810, not only the entire size of the flat miniaturized antenna 80 can be reduced but also the bandwidth of the flat miniaturized antenna 80 can be broadened for increasing the transmitting and receiving efficiency of wireless signals.

Specifically, the flat miniaturized antennas 10, 40, 50, 70, and 80 as shown in FIGS. 1, 4, 5, 7, and 8 respectively are only embodiments of the present invention. The structure of the antennas mentioned above can be changed by those skilled in the art to fit different wireless communication devices. For example, please refer to FIGS. 10, 11, 12, 13, and 14. FIGS. 10, 11, 12, 13, and 14 are diagrams of flat miniaturized antennas 101, 110, 120, 130, and 140 respectively according to other embodiments of the present invention.

The present invention utilizes a tapering meander-shaped conductor, a sleeve conductor, and branch conductors to reduce the entire size of the antenna and effects from environment and mechanism, and broaden the bandwidth of the antenna for increasing transmitting and receiving efficiency of wireless signals.

Those skilled in the art will readily observe that numerous modifications and alterations of the device and method may be made while retaining the teachings of the invention. Accordingly, the above disclosure should be construed as limited only by the metes and bounds of the appended claims.

The invention claimed is:

1. A flat miniaturized antenna of a wireless communication device comprising:

a baseboard;

a sleeve conductor formed on the baseboard and coupled to system ground;

a meander-shaped conductor formed on the baseboard in a reciprocating bent manner having a wide end and a narrow end; and a feed-in end formed on the wide end of meander-shaped conductor for transmitting wireless signals received by the meander-shaped conductor to the wireless communication device.

2. The flat miniaturized antenna of claim 1, wherein the meander-shaped conductor is formed inside the sleeve conductor and is isolated from the sleeve conductor.

3. The flat miniaturized antenna of claim 1, wherein the length of the sleeve conductor is about a quarter of the wavelength of the signal fed into the feed-in end.

4. The flat miniaturized antenna of claim 1, wherein the baseboard is made of a dielectric material or a magnetic material.

5. The flat miniaturized antenna of claim 1, wherein the length of the meander-shaped conductor is about a quarter of the wavelength of the signal fed into the feed-in end.

6. The flat miniaturized antenna of claim 1, wherein the width of the meander-shaped conductor is reduced linearly from the wide end to the narrow end.

7. A flat miniaturized antenna of a wireless communication device comprising:

a baseboard;

a sleeve conductor formed on the baseboard and coupled to system ground;

a meander-shaped conductor formed inside the sleeve conductor and isolated from the sleeve conductor, the width of an end of the meander-shaped conductor close to the sleeve conductor being greater than the width of the other end;

a feed-in end formed on a wider end of the meander-shaped conductor for transmitting wireless signals received by the meander-shaped conductor to the wireless communication device; and a branch conductor coupled to the meander-shaped conductor.

8. The flat miniaturized antenna of claim 7, wherein the baseboard is made of a dielectric material or a magnetic material.

9. The flat miniaturized antenna of claim 7, wherein the length of the sleeve conductor is about a quarter of the wavelength of the signal fed into the feed-in end.

10. The flat miniaturized antenna of claim 7, wherein the width of the meander-shaped conductor is reduced linearly from the wider end to the other end.

11. The flat miniaturized antenna of claim 7, wherein the branch conductor is coupled to an end of the meander-shaped conductor different from the feed-in end of the meander-shaped conductor.

12. The flat miniaturized antenna of claim 11, wherein the sum of the length of the meander-shaped conductor and the length of the branch conductor is about a quarter of the wavelength of the signal fed into the feed-in end.

13. The flat miniaturized antenna of claim 7 further comprising a plurality of branch conductors coupled to the meander-shaped conductor.

* * * * *